US008371194B2

(12) United States Patent
Wu et al.

(10) Patent No.: US 8,371,194 B2
(45) Date of Patent: Feb. 12, 2013

(54) WRENCH EQUIPPED WITH A PRECISE TORQUE-MEASURING DEVICE

(75) Inventors: Yi-Min Wu, Taichung (TW); Jih-Chun Wu, Taichung (TW)

(73) Assignee: Matatakitoyo Tool Co., Ltd., Taichung (TW)

( * ) Notice: Subject to any disclaimer, the term of this patent is extended or adjusted under 35 U.S.C. 154(b) by 283 days.

(21) Appl. No.: 12/870,836

(22) Filed: Aug. 29, 2010

(65) Prior Publication Data

US 2012/0048073 A1 Mar. 1, 2012

(51) Int. Cl.
*B25B 23/142* (2006.01)

(52) U.S. Cl. ..... 81/478; 81/467

(58) Field of Classification Search ..... 73/862.21, 73/862.23, 862.193, 862.08, 862.26; 81/478, 81/467, 469, 471, 479, 468, 472, 473, 475, 81/477, 483

See application file for complete search history.

(56) References Cited

U.S. PATENT DOCUMENTS

| | | | | |
|---|---|---|---|---|
| 4,541,313 | A * | 9/1985 | Wise | 81/478 |
| 5,581,042 | A * | 12/1996 | Tambini | 73/862.21 |
| 6,070,506 | A * | 6/2000 | Becker | 81/479 |
| 6,334,377 | B1 * | 1/2002 | Wu | 81/478 |
| 6,722,235 | B2 * | 4/2004 | Hsieh | 81/478 |
| 6,928,885 | B1 * | 8/2005 | Shiao et al. | 73/862.21 |

* cited by examiner

*Primary Examiner* — Robert Pezzuto

(57) ABSTRACT

A wrench includes a shank including a slot defined therein longitudinally, a handle attached to an end of the shank, a head, a torque assembly for connecting the head to another end of the shank, a torque-setting device and a torque-measuring device. The torque-setting device includes a knob inserted in the handle and a pin movable in and along the slot as the knob is spun. The torque-measuring device includes a measurement sleeve and a collar. The measurement sleeve is rotationally located around the shank and includes a helical groove defined in an internal side and a scale provided on an external side. A portion of the pin is movably inserted in the helical groove so that the measurement sleeve is spun as the pin is moved in and along the slot. The collar is located around the shank and includes a window through which the scale is observable.

7 Claims, 7 Drawing Sheets

WRENCH EQUIPPED WITH A PRECISE TORQUE-MEASURING DEVICE

BACKGROUND OF INVENTION

1. Field of Invention

The present invention relates to a wrench and, more particularly, to a wrench equipped with a precise torque-measuring device.

2. Related Prior Art

As disclosed in U.S. Pat. No. 4,870,879, a wrench includes a ratchet arm 1, a shank 3, a torque assembly 2 arranged between the ratchet arm 1 and the shank, a handle 40 connected to the shank, and a dial 41 connected to the torque assembly 2. The dial 41 is allowed to spin relative to the handle 40. The dial 41 includes a scale 411. The handle 40 includes a pointer 401. The dial 41 is spun to set a maximum value of torque that can be transmitted to the ratchet arm 1 from the shank 3 and the handle 40 via the torque assembly 2. The pointer 401 and the scale 411 are used to show the maximum value of torque. The scale is based on N-m, lb-ft or kg-m. The scale 411 however cannot show the maximum value of torque precisely.

Such wrenches can be found in U.S. Pat. Nos. 2,205,510, 4,248,107, 7,044,036, 7,631,583 and D257626 for example. These wrenches cannot show the maximum value of torque precisely for reasons. At first, it is difficult to align the scale 411 to the pointer 401 precisely. Secondly, the precision in setting a digit in the ten's or hundred's place of a value of torque is acceptable; however, the precision in setting a digit in the unit's place of the value of torque is poor. This problem is particularly serious with U.S. Pat. No. 7,631,583 wherein the set value of the maximum value of torque must be compared with that is measured with an electronic measurement device. Thirdly, several dials are operated to set the maximum value of torque as disclosed in U.S. Pat. No. 7,631,583, and this is inconvenient.

The present invention is therefore intended to obviate or at least alleviate the problems encountered in prior art.

SUMMARY OF INVENTION

It is the primary objective of the present invention to provide a wrench that shows values of torque precisely.

To achieve the foregoing objective, the wrench includes a shank including a slot defined therein longitudinally, a handle attached to an end of the shank, a head, a torque assembly for connecting the head to another end of the shank, a torque-setting device and a torque-measuring device. The torque-setting device includes a knob inserted in the handle and a pin movable in and along the slot as the knob is spun. The torque-measuring device includes a measurement sleeve and a collar. The measurement sleeve is rotationally located around the shank and includes a helical groove defined in an internal side and a scale provided on an external side. A portion of the pin is movably inserted in the helical groove so that the measurement sleeve is spun as the pin is moved in and along the slot. The collar is located around the shank and includes a window through which the scale is observable.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
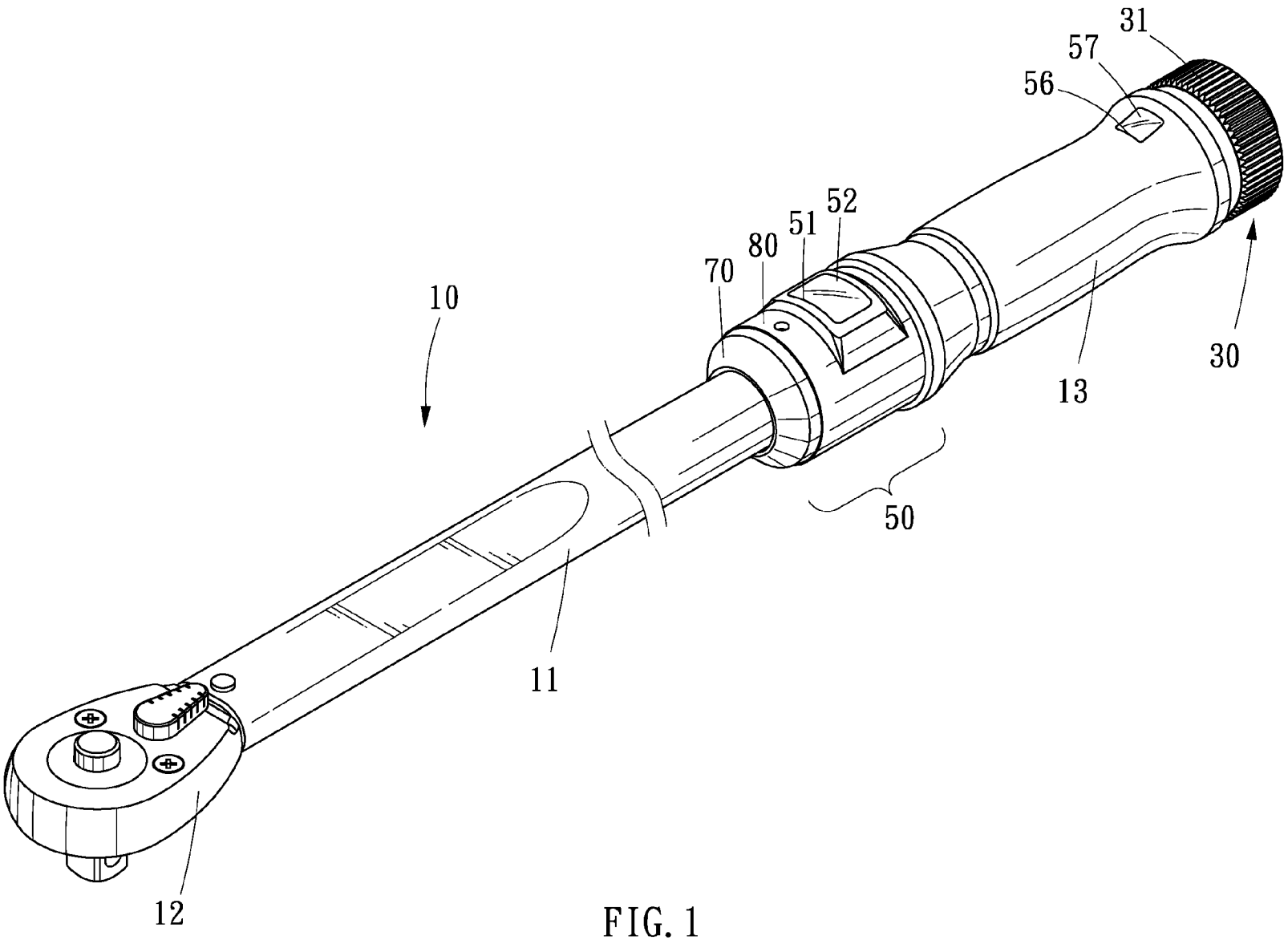
FIG. 1 is a perspective view of a wrench according to the preferred embodiment of the present invention.
Figure 2:
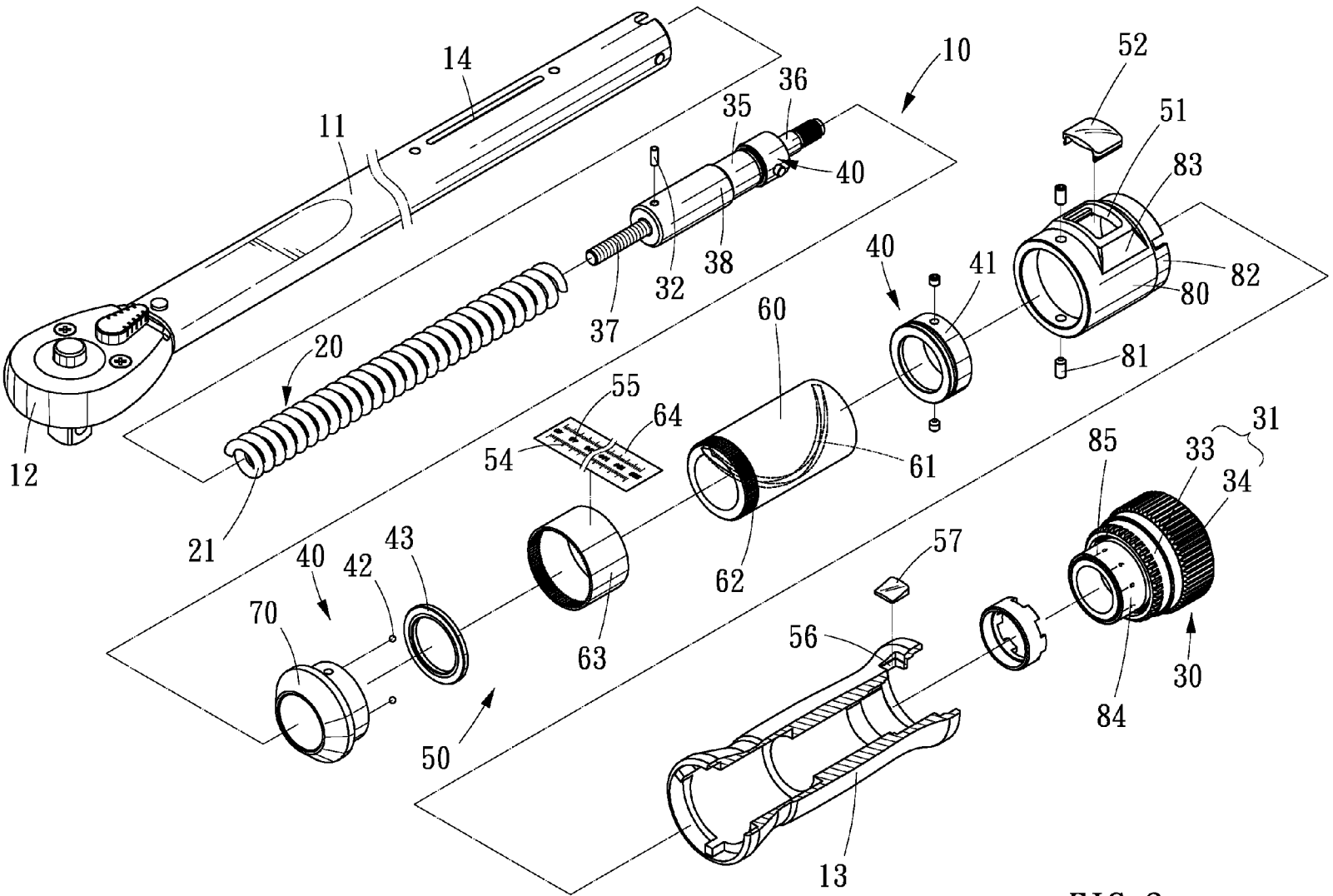
FIG. 2 is an exploded view of the wrench shown in FIG. 1.
Figure 3:
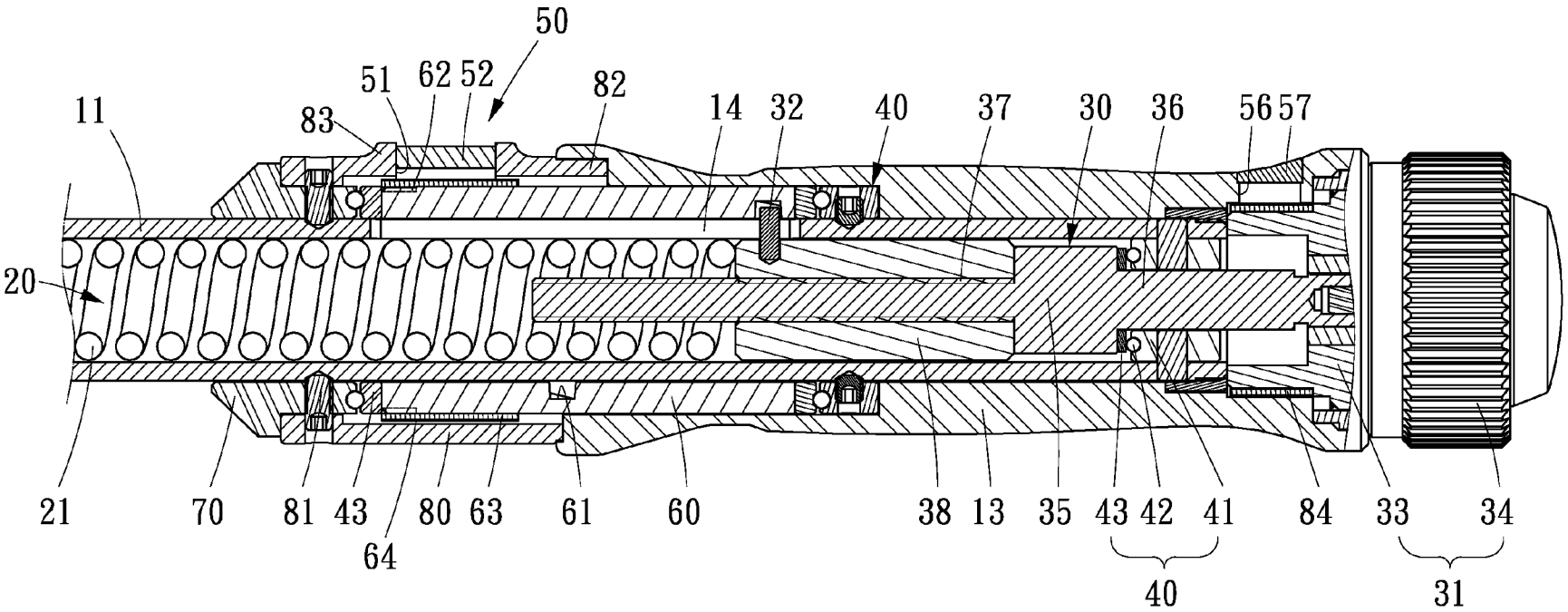
FIG. 3 is a partial, cross-sectional view of the wrench shown in FIG. 1.
Figure 4:
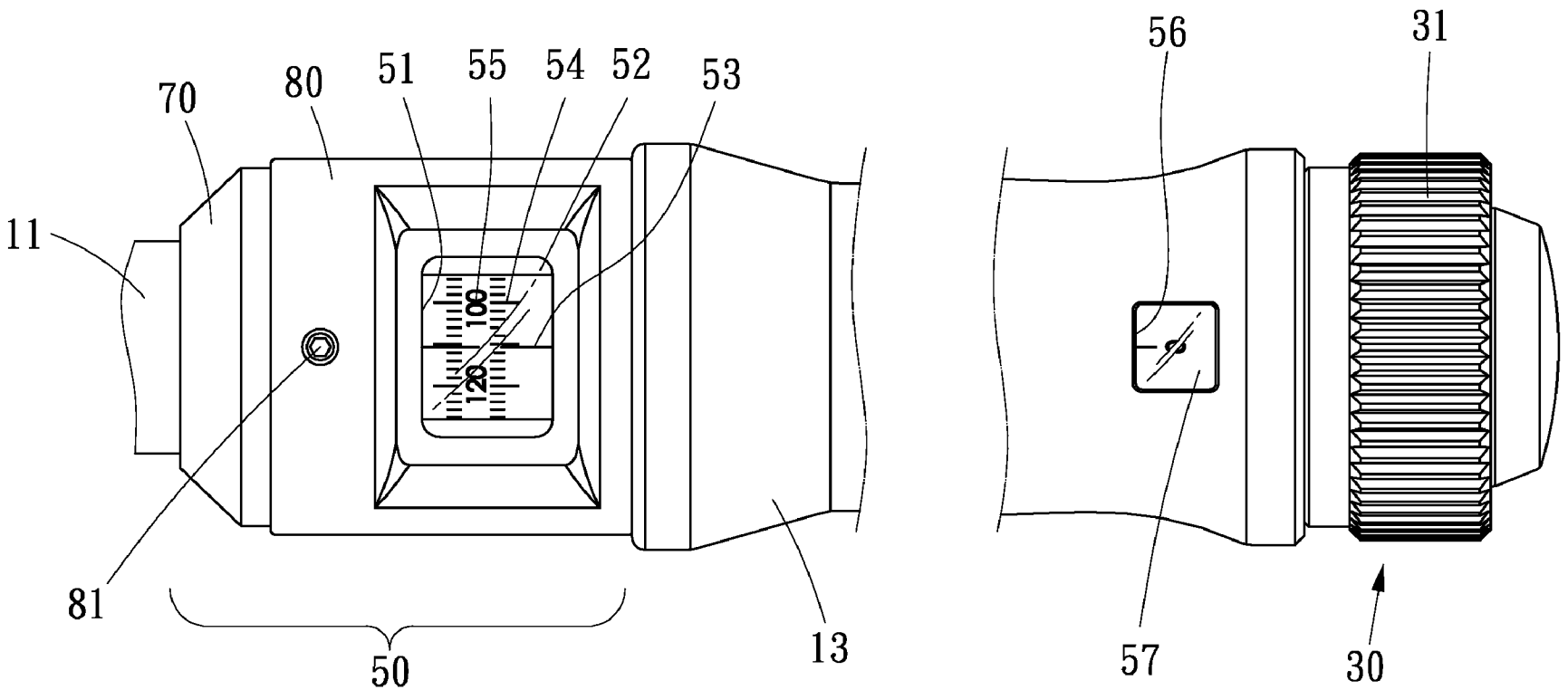
FIG. 4 is a partial, top view of the wrench shown in FIG. 1.

Referring to FIGS. 1 through 3, a wrench 10 includes a shank 11, a head 12, a handle 13, a torque assembly 20, a torque-setting device 30 and a torque-measuring device 50 according to the preferred embodiment of the present invention. The shank 11 is a tubular element with a slot 14 defined therein longitudinally. The handle 13 is attached to an end of the shank 11. The handle 13 includes a window 56 defined therein. A lens 57 is fit in the window 56. The lens 57 is preferably a magnifier.

The torque assembly 20 is located in the shank 11. The head 12 is attached to an opposite end of the shank 11 via the torque assembly 20. The torque assembly 20 includes a spring 21. Further details of the torque assembly 20 can be found in U.S. Pat. No. 4,870,879.

Figure 7:
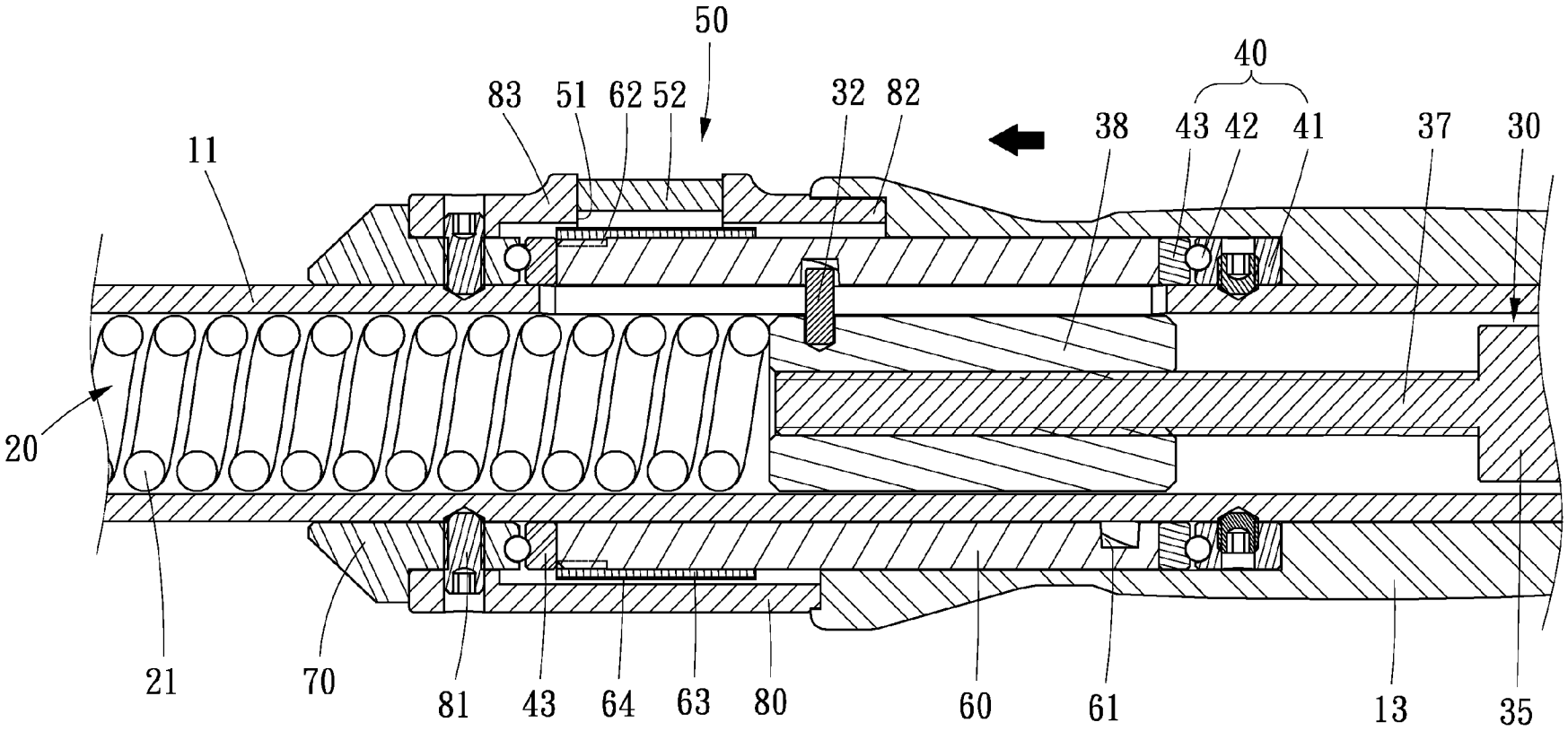
FIG. 7 is a partial, cross-sectional view of the wrench in another position than shown in FIG. 3.

The torque-setting device 30 includes a knob assembly 31, a bolt 35, a pusher 38 and a pin 32. The pusher 38 is a tubular element with a thread extending on an internal side. The pusher 38 is located in the shank 11, against the spring 21. The pin 32 is transversely driven in the pusher 38 via the slot 14. Thus, the pusher 38 is movable in and along the shank 11 while the pin 32 is movable in and along the slot 14 as clearly shown in FIG. 7.

The bolt 35 includes a thread 37 extending thereon near an end and an insert 36 axially extending from an opposite end. The thread 37 of the bolt 35 is engaged with the thread of the pusher 38. With the pin 32 movable in and along the slot 14 and the thread 37 of the bolt 35 engaged with the thread of the pusher 38, the pusher 38 is moved in and along the shank 11 when the bolt 35 is spun in the pusher 38.

The knob assembly 31 includes a knob 34 and a lining 33. The lining 33 includes teeth formed on an internal side. The teeth of the lining 33 are engaged with teeth formed on the insert 36 of the bolt 35 so that they can be spun together. That is, the bolt 35 is spun by operating the lining 33. The knob 34 is fit around the lining 33 so that they can be spun together.

Figure 5:
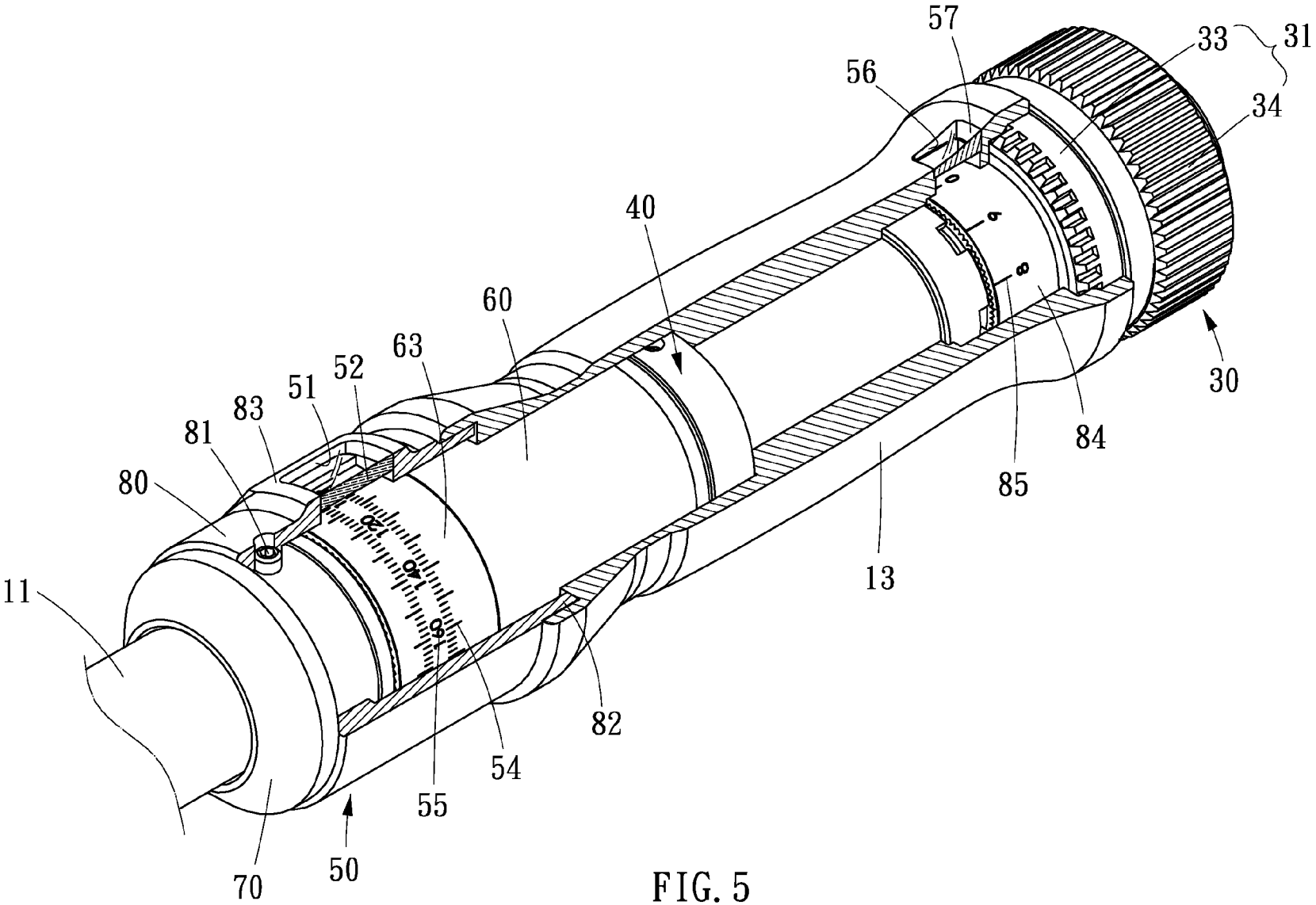
FIG. 5 is a partial, cut-away view of the wrench shown in FIG. 1.

A scale 85 is provided on a sticker attached to a ring 84 fit around the lining 33. Alternatively, the scale 85 may directly be provided on the ring 84. The scale 85 is used to show a digit in the unit's place of a value of torque. To this end, the scale 85 includes ten notches of "0" through "9." The scale 85 is aligned with the window 56 so that the scale 85 is clearly observable through the lens 57 (FIG. 5).

A first bearing 40 is located in the shank 11. The first bearing 40 includes balls 42 located between two annular elements 41 and 43. The annular element 41 is secured to the shank 11 with two pins or no-return screws. A section of the bolt 35 formed with the insert 36 is inserted through the annular element 41. The annular element 43 is rotational relative to the annular element 41 because of the balls 42. The annular element 43 is located against an enlarged section of the bolt 35. Thus, the bolt 35 can smoothly spin in the shank 11.

The torque-measuring device 50 includes a measurement sleeve 60, a cover 70 and a collar 80.

Figure 6:
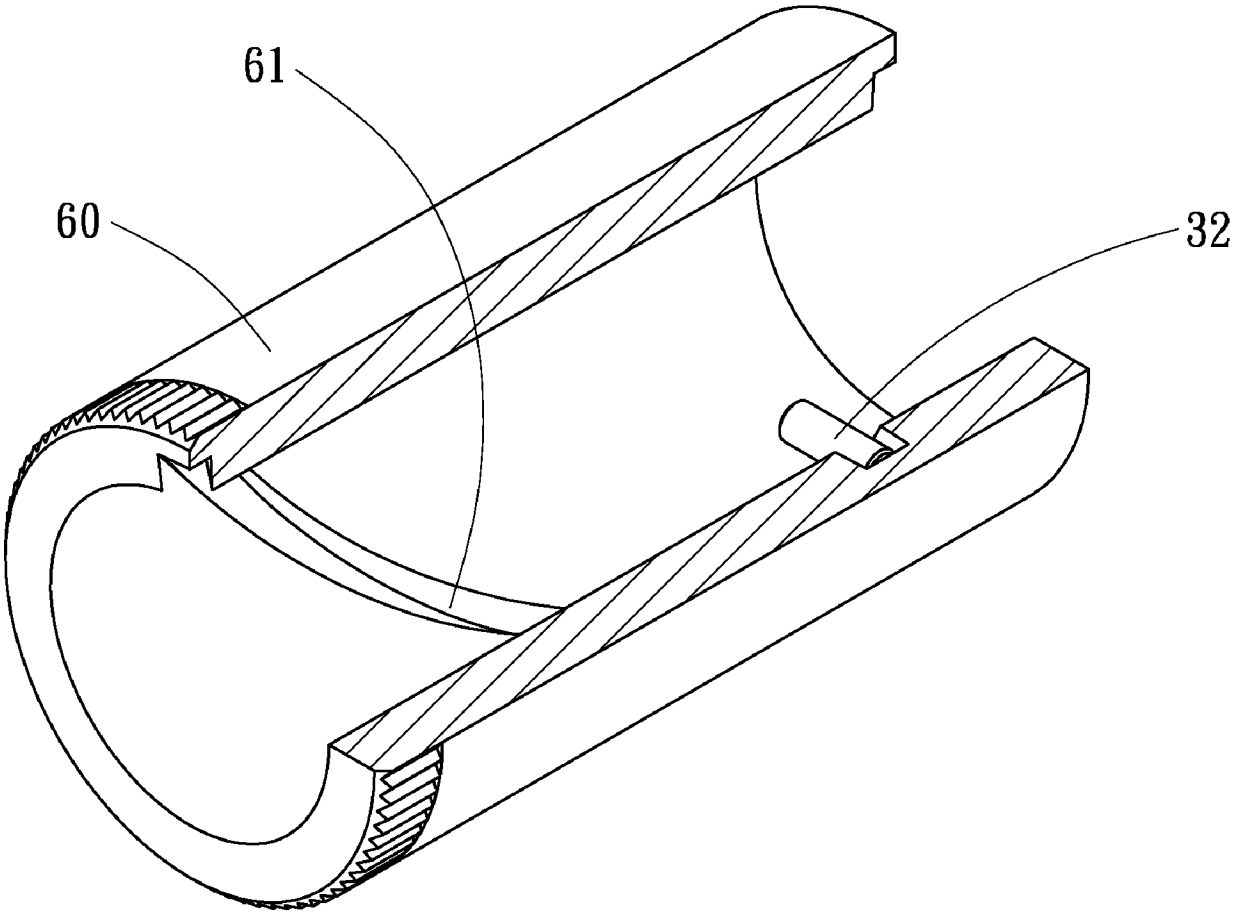
FIG. 6 is a top view of a measurement sleeve used in the wrench shown in FIG. 1.

The measurement sleeve 60 includes a groove 61 defined in an internal side and teeth 62 formed on an external side. The groove 61 extends in a helical path as clearly shown in FIG. 6. The groove 61 includes at least one open end. The measurement sleeve 60 is rotationally located around the shank 11. An end of the pin 32 is moved into the groove 61 from the open end of the latter. The end of the pin 32 is movable in and along the groove 61 so that the measurement sleeve 60 is spun around the shank 11.

A ring 63 includes, on an internal side, teeth engaged with the teeth 62 of the measurement sleeve 60 so that the ring 63 can spin together with the measurement sleeve 60. A scale 64 is provided on a sticker attached to the ring 63. Alternatively, the scale 64 may directly be provided on the ring 63. The scale 64 includes notches 54 and numerals 55. The scale 64 is used to show a digit in the ten's place of the value of torque and a digit in the hundred's place of the value of torque.

The scales 85 and 64 and the pitch of the groove 61 are designed so that the scale 85 changes by ten notches and the scale 64 changes by one notch as the knob assembly 31 is spun for 360°.

A second bearing 40 is located around the shank 11 before the measurement sleeve 60. The annular element 41 of the second bearing 40 is secured to the shank 11 with two pins or no-return screws. The annular element 43 of the second bearing 40 is located against an end of the measurement sleeve 60.

A third bearing 40 is located around the shank 11 after the measurement sleeve 60. The annular element 43 of the third bearing 40 is located against an opposite end of the measurement sleeve 60. The annular element 41 of the third bearing 40 is however replaced with the cover 70 secured to the shank 11 with two pins or no-return screws. The measurement sleeve 60 can smoothly spin around the shank 11 due to the use of the second and third bearings 40.

The collar 80 includes a reduced section 82 formed at an end and a raised portion 83 formed thereon. A window 51 is defined in the raised portion 83 of the collar 80. A lens 52 is fit in the window 51. The lens 52 is preferably a magnifier. The lens 52 is made with a pointer 53 in the form of a line. The collar 80 is located around the shank 11. The window 51 is aligned with the scale 64 so that the scale 64 is clearly observable via the lens 52 (FIG. 5). The collar 80 is secured to the shank 11 by two pins or no-return screws 81.

The torque-measuring device 50 exhibits several advantages. Firstly, the value of torque can precisely be shown. That is, the digit in the unit's place of the value of torque is shown by the scale 85 while the digits in the ten's and hundred's places of the value of torque are shown by the scale 64. As the knob assembly 31 is turned, the pin 32 is reciprocated in and along the slot 14 and in and along the groove 61 so that the measurement sleeve 60 is spun around the shank 11.

Secondly, the lenses 52 and 57 ensure clear observation of the scales 64 and 85. The lenses 52 and 57 protect the scales 64 and 85 from damages and contamination. Moreover, the lenses 52 and 57 are magnifiers for magnify the scale 64 and 85. The pointer 53 facilitates the clear observation of the scale 64.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A wrench including:

a shank including a slot defined therein longitudinally;

a handle attached to an end of the shank and made with a window;

a head;

a torque assembly for connecting the head to another end of the shank;

a torque-setting device including:

a knob assembly rotationally inserted in the handle;

a bolt connected to the knob assembly so that they are rotatable together;

a pusher in engagement with the bolt in a threaded manner and in contact with the torque assembly; and a pin including a first end connected to the bolt and a second end extending through the slot so that the pin is movable along the slot as the knob assembly is spun;

a torque-measuring device including:

a sleeve rotationally located around the shank and made with a helical groove in an internal side and;

a first scale provided on an external side of the sleeve, wherein the second end of the pin is inserted in the helical groove so that the first scale is rotated together with the sleeve as the pin is moved along the slot when the knob assembly is rotated to set a maximum value of torque that can be exerted with the wrench; and a collar located around the shank and made with a window through which the first scale is observable; and a second scale provided on a section of the knob assembly inserted in the handle so that the second scale is rotatable together with the knob assembly and observable via the window of the handle.

2. The wrench according to claim 1, wherein the torque-measuring device includes a lens fit in the window of the collar.

3. The wrench according to claim 2, wherein the lens is a magnifier.

4. The wrench according to claim 1, wherein the torque-measuring device includes a ring fit around the sleeve, wherein the first scale is provided on the ring.

5. The wrench according to claim 1, wherein the torque-measuring device includes a lens fit in the window of the handle.

6. The wrench according to claim 5, wherein the lens is a magnifier.

7. The wrench according to claim 1, wherein the torque-measuring device includes a ring fit around the knob assembly, wherein the second scale is provided on the ring.

* * * * *